United States Patent [19]

Fonda

[11] Patent Number: 4,659,959

[45] Date of Patent: Apr. 21, 1987

[54] SHADOW MASK FOR A COLOR PICTURE TUBE AND PICTURE TUBE INCORPORATING THE SAME

[75] Inventor: Carlo L. Fonda, Anagni, Italy

[73] Assignee: Videocolor, Montrouge, France

[21] Appl. No.: 673,826

[22] Filed: Nov. 21, 1984

[30] Foreign Application Priority Data

Nov. 25, 1983 [FR] France ..... 83 18852

[51] Int. Cl.[4] ..... H01J 29/07

[52] U.S. Cl. ..... 313/407; 313/408

[58] Field of Search ..... 313/402, 405, 407, 408

[56] References Cited

U.S. PATENT DOCUMENTS 4,517,487 5/1985 Tamburriano ..... 313/407

FOREIGN PATENT DOCUMENTS 2713765 10/1978 Fed. Rep. of Germany ..... 313/407

OTHER PUBLICATIONS

Patents Abstracts of Japan, vol. 6, No. 194, Oct. 2, 1982, p. 1072E134 and JP—A—57 105 945.

Patents Abstracts of Japan, vol. 1, No. 41, Apr. 22, 1977, p. 1503E76 and JP—A 51 138 383.

*Primary Examiner*—Palmer C. DeMeo

*Assistant Examiner*—Sandra L. O'Shea

*Attorney, Agent, or Firm*—Pollock, VandeSande & Priddy

[57] ABSTRACT

Slotted shadow mask for a color picture tube mounted on an L-section frame having a lateral wall and a radial wall which are integral and extend toward the tube axis. The mask is bordered by a skirt having an axial generatrix, whose height is preferably between a third and a quarter the height of the lateral wall of the frame and whose thickness is less than ten times the thickness of the mask. The free inner end of the radial wall of the frame is bent in the opposite direction to the mask in order to form a stiffening lip and opening for the passage of electrons up to the edge of the metal surface of the mask.

2 Claims, 7 Drawing Figures

SHADOW MASK FOR A COLOR PICTURE TUBE AND PICTURE TUBE INCORPORATING THE SAME

BACKGROUND OF THE INVENTION

The present invention relates to a shadow mask or color selection electrode for a color television picture tube, as well as the support frame making it possible to stiffen or rigidify the mask.

A cathode ray tube for reproducing color television pictures generally comprises a glass envelope formed from a front panel or plate having a rectangular shape and extended by a skirt-like side wall, sealed to a conical part which narrows and which is terminated by the cylindrical or tubular neck with at its end three electron guns and having fitted to its outside horizontal and vertical electromagnetic deviators making it possible to sweep the phosphor screen.

This screen formed from phosphors of the three primary colors, red, blue and green, is deposited on the inner face of the front panel. In one type of color picture tube where the electron guns emit three parallel electron beams in the same horizontal plane, said screen is constituted by a repeated succession of three continuous bands of vertical phosphors having different colors R, G, B.

A color selection electrode constituted by a spherical or cylindrical metal surface 10 (FIG. 1) perforated by a large number of elongated rectangular or oblong openings or slots 11, called a shadow mask 12, is placed on the trajectory of the three electron beams in the vicinity of and substantially parallel to the screen, which has a shape identical to that of the surface 10. The effect of the shadow mask 12 is only to permit the passage of that part of each electron beam which is directed towards one of the bands of phosphors R, G and B, in such a way that the first beam is intended for the green bands G, a second beam for the blue bands B and a third beam for the red bands R, as a result of their different incidence angles at the location of slots 11. It should be noted that a single beam can have a section covering several slots 11 at once, as well as a circular area on the metal surface 10 surrounding them. Thus, approximately 80%, of the electrons of each beam is received by the metal surface 12, which is also called the mask fabric, which blocks their passage and absorbs the high kinetic energy thereof. This leads to a rapid heating of that part of surface 10 swept by the beams and which has a low thermal inertia.

Thus, during the manufacture of the tube, the shadow mask 12 must be removed and refitted several times and must also be able to withstand predetermined mechanical vibrations and shocks without undergoing any deformation or permanent displacement; it is generally supported by a rigid metal frame 16 (FIGS. 1 and 2) which is preferably made from a profile with an L-shaped cross-section and a thickness which considerably exceeds that of the mask (e.g. by 10 to 15 times). In the prior art tube constructions, described e.g. in FR-A-Nos. 1 470 260 and 1 486 675, the thickness of the metal sheet from which the metal surface 10 of mask 12 is made is generally between 100 and 200 micrometers, while that of the frame 16 is generally between 2 and 3 millimeters as a function of the screen dimensions. Therefore the thermal inertia of frame 16 is much higher and it is only heated much less slowly.

Thus, the shadow mask 12, which is permanently bombarded by electron beams and which is much thinner and weighs much less than the frame which is thick and heavy, is heated much more rapidly than the latter as soon as the tube is put into operation. The frame is only bombarded by electrons at the start and finish of each scanning line and field and only reaches its equlibrium temperature (when the heat supplied becomes equal to that dissipated) much later. Therefore mask 12 is subject to an expansion in its plane (in the radial direction) well before frame 16 starts to heat and expand. There is then swelling or convex curving of mask 12, whereof the center which is at the same time the apex, approaches the screen, and whereof the edges welded to the frame 16 remain in place through the latter, which is fixed to the skirt of the front panel with the aid of a conventional leaf or plate spring arrangement. This swelling of the shadow mask 12 leads to respective displacements of slots 11 of surface 10, which are purely axial in the center and which have decreasing axial components from the center towards the periphery (where they are initially zero) and radial components which increase from the center (where they are zero) to approximately midway between the center and the edge (where they reach their maximum value) and from there decrease up to the edge (where they are initially zero). This is diagrammatically illustrated in section in FIG. 1, where the broken line curve A shows the profile of a cold frame 16 and mask 12, while the dot - dash line curve B shows the profile of a hot mask 12 and a cold frame 16 bringing about the said swelling, indicated by a reduction in the radius of curvature of mask 12. The aforementioned displacement of slots 12 have the effect of displacing the axes of the beam portions, called index or chromogen strips, which pass through the same with respect to the vertical axes of the bands of phosphors R, G and B combined in juxtaposed triplets, so as to give rise to register losses or alignment faults, which are at their highest level in an annular area located roughly midway between the center and edge of mask 12.

This can lead to a relative reduction of the light intensity proportional to the surface of the bombarded phosphor (if the bands are separated by phosphor-free areas) or color purity faults, because a beam intended for a single phosphor will partly drop on to an adjacent band of another color.

After a given operating time of the tube, the frame 16 is also progressively heated by conduction, radiation, and electron bombardment, so that it also undergoes a thermal expansion. Frame 16 and mask 12 are generally made from the same material (rolled steel), so that they have the same thermal expansion coefficient. The expansion of frame 16, following that of mask 12, has the effect of, on the one hand, producing its previously noted swelling (accompanied by flattening with respect to the curve B of FIG. 3) and on the other hand increasing the distance between slots 11 thereof, i.e. radially displacing the same. This is diagrammatically illustrated in section in FIG. 2, whereof the broken line curve A (identical so that of FIG. 1) shows the profile of an assembly formed from cold frame 16 and mask 12, while the continuous line curve C shows a hot frame 16 and mask 12 assembly, i.e. which have reached the same equilibrium temperature. It can be seen that the area or extent of mask 12, as well as the distance between the pairs of parallel branches, have increased and that the radius of curvature of mask 12, following a brief reduction due to an initial swelling, becomes slightly larger than that which it had in the cold state. If the frame 16 is only suspended with the aid of spring plates, whose longitudinal axes are located in the same radial (transverse) plane and which are oriented substantially tangentially with respect to the circumference, frame 16 can expand in its plane without undergoing any axial displacement. This has the effect of stretching the spherical metal surface 10, in such a way that it spreads and is slightly flattened. Thus, mask 12 undergoes a slight axial displacement at the center, which increases with the radial distance, as well as a spreading in the radial direction, which has the effect of producing an increase in the spacing and to a lesser extent an increase in the width of slots 11. This causes register losses due to the spreading of slots 11 in the plane of expanded surface 10, which increase with the radial distance thereof with respect to the axis of the tube (i.e. with respect to the center of mask 12). It has been found that a supplementary displacement of the hot frame 16 - mask 12 assembly (profile C) in the direction of the screen following the tube axis has made it possible to compensate these register losses, because it makes it possible to substantially maintain the center of curvature of the surface of mask 12 in the intersection of the axis of the tube with the deviation plane normal to said axis. Such a forward axial displacement is illustrated by profile D (without frame) in FIG. 2 and has been obtained either by leaf springs oriented normally to the maximum deflection beams which the expansion of the frame pivots around two transverse folds or bends, in such a way that frame 16 moves towards the screen (cf. e.g. FR-A-No. 1 540 869) or with the aid of intermediate compensating members inserted between one end of the leaf spring and frame 16 formed from biplates, each constituted by two metal plates having different thermal expansion coefficients and which are superimposed and intimately joined together. These two solutions appear in the aforementioned FR-A-No. 1 486 675. These bimetallic compensating members, which can be intermediate between the spring and the frame (cf. also FR-A-Nos. 2 035 074 or 2 107 515) or constituted by biplate springs (cf. FR-A-Nos. 1 597 297 and 2 011 387) make it possible to compensate the alignment defect of slots 11 with the triplets R, G and B of the screen as a function of the temperature of frame 16 to which they are joined by welding. However, they do not intervene due to the initial swelling of mask 12, due to the significant difference between the respective thermal inertias (and weights) of the mask and the frame 16.

It has been possible to sigificantly reduce this swelling, together with other torsional effects exerted on the edges of the mask 12 by limiting the number of welding points joining the skirt of mask 12 to the belt of frame 16 which are parallel, or by providing the mask skirt or the frame belt with an alternating arrangement of radial cavities and projections limiting the contacting surfaces between the frame and skirt to areas surrounding the weld points. A supplementary reduction of this swelling has been obtained by reducing the radius of curvature of the metal surface compared with that of the conventional mask whereof the cold distance from the screen is substantially constant over its entire area. This measure also implies a variation in the spacing of the axes of the adjacent slots 11, as a function of the radial distance separating them from the center of mask 12, which increases the tolerances. It is pointed out that the tubes with parallel guns "in line" with lined screens and slotted masks are not very sensitive to register losses in the vertical direction, but are very sensitive thereto in the horizontal direction.

Apart from the overall swelling of the perforated mask, due to the slower heating of the frame, a localized swelling phenomenon has also been noted and is dependent on the content of the televised picture. For example, when the picture comprises two highly contrasted areas, whereof one is bright and the other dark, the number of electrons trapped by the area of the mask facing the former will be much greater than that received by the area of the mask facing the latter. It is obvious that the area which is bombarded most will rapidly reach a much higher temperature than that receiving few electrons; and due to the limited thickness and thermal conductivity of the mask, the respective temperatures of these two areas would remain different during a certain time interval if the contrasted picture persisted.

Color picture tubes usable more particularly for display purposes in informatics (e.g. in video) or in high definition television must have screens with finer or thinner phosphor bands and masks with less widely spaced slots (e.g. spacing reduced from 0.8 to 0.5 mm) than the presently available tubes. As a result there are greatly reduced tolerances with regards to the radial displacements of the slots, i.e. register faults due to swelling. Thus, a significant reduction (15 to 25 $\mu$m) of the temporary swelling on starting up is indispensable.

It should also be noted that a flatter screen (i.e. with an increase in its radius of curvature) has the effect of increasing the register loss due to swelling. On combining the flat screen with an improved resolution, there is a further increase in the swelling reduction requirements.

The Applicant has found that it is possible to reduce the amplitude and duration of the temporary swelling of the mask by using a reduced thickness frame reinforced by at least one rib or bend, in order to have a mechanical rigidity comparable to that of a conventional thick frame with a L-shaped section.

SUMMARY OF THE INVENTION

The object of the invention is to increase the thermal stability of the mask - frame assembly and reduce both the amplitude and duration of the swelling compared with the prior art solutions, while ensuring an adequate rigidity thereof.

According to the invention this result is achieved by a combination of a short mask skirt and a lighter frame provided with a rib at its end opposite to the mask.

Thus, the present invention relates to a shadow mask for a color television tube comprising a trichromatic lined screen formed from a repeated succession of three different phosphor bands respectively bombarded by three electron beams through a perforated surface of the shadow mask provided with slots forming a color selection electrode, said mask comprisisng a profiled support frame having a substantially L-shaped cross-section, formed from a side wall or belt engaged against a skirt integrally surrounding the edges of the mask and a radial wall or base integral with the belt and extending towards the axis of the tube.

According to the invention, the mask - frame assembly is remarkable particularly as a result of the combination of the following features:

(a) the skirt of the mask has a height between at the most one third and a quarter of the height of the belt surrounding it or which it surrounds;

(b) the thickness of the frame is less than ten times the thickness of the fabric of the mask; and (c) the free end of the radial wall of the frame comprises a bent lip constituting on the one hand a stiffening rib and on the other a window opening making it possible to bombard the edges of the mask up to the vicinity of the junction of the fabric with the skirt.

BRIEF DESCRIPTION OF THE DRAWINGS

The invention is described in greater detail hereinafter with reference to non-limitative embodiments and the attached drawing, wherein show.

DETAILED DESCRIPTION OF THE PREFERRED EMBODIMENTS

Figure 1:
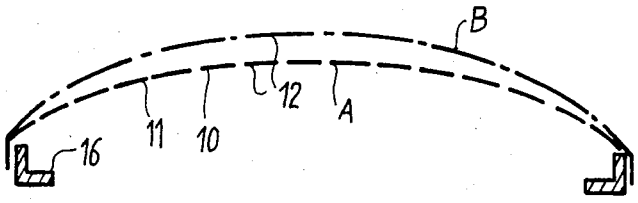
FIGS. 1 and 2 already described, diagrammatic sections of the mask - frame assembly.
Figure 2:
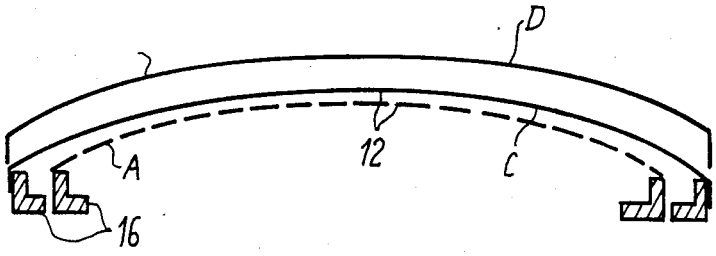
Figure 3:
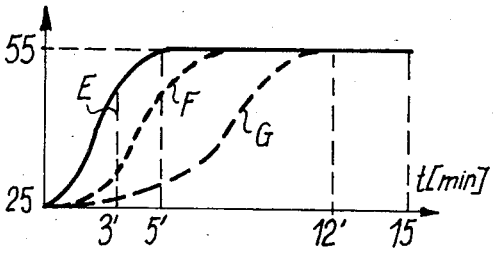
FIG. 3 a graph of the evolution of the respective temperatures of a mask, a lightweight (thin) frame and a heavy (thick) frame.

FIG. 3 is a graph illustrating the temperature variation with the operating time respectively with respect to a shadow mask E, a lightweight frame F and a conventional heavy frame G. The operating time of the tube (with a fast heating cathode) is plotted on the abscissa and the temperature of each element is plotted on the ordinate.

On the continuous line curve E, it is possible to see that the low weight shadow mask heats rapidly and reaches its equilibrium temperature (55° C.) after 5 minutes of electronic bombardment. A low weight frame (approx. 1.2 mm) has a temperature rise curve in broken lines F indicating a slower heating, so that it only reaches its equilibrium temperature after roughly nine minutes. A heavy frame (2.8 mm thick) has an even slower dot - dash line rise curve G and only reaches its equilibrium temperature after approximately 12 to 15 minutes. On comparing curves E, F and G, it is easy to see that the maximum temperature difference between the mask and the light frame is reached in approximately 3 minutes, while that between the mask and the heavy frame takes place after 5 to 6 minutes operating time in an exemplified manner. Moreover, it is possible to see that the magnitude of this maximum difference is greater in the second case, which shows the advantage of the lightweight frame. These examples are only given in an exemplified manner and are more particularly dependent on the tube format, (screen sizes).

The use of thinner and therefore lighter frame, but which is arranged in such a way as to retain an adequate mechanical rigidity with respect to shocks and vibrations would appear to be advantageous, on the one hand for reducing the swelling phenomenon in both amplitude and duration by a rapid expansion of the frame (reduced thermal inertia) and on the other hand for shortening the time necessary for starting up the compensation of the overall expansion with the aid of intermediate biplates between the frame and the panel, and which are rapidly heated in this case.

Figure 4:
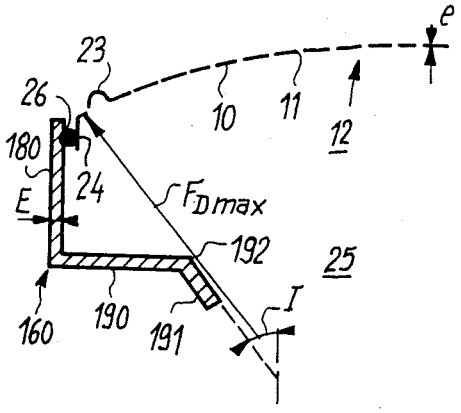
FIG. 4 a partial diagrammatic section through a short skirt mask with an external lightweight frame.
Figure 5:
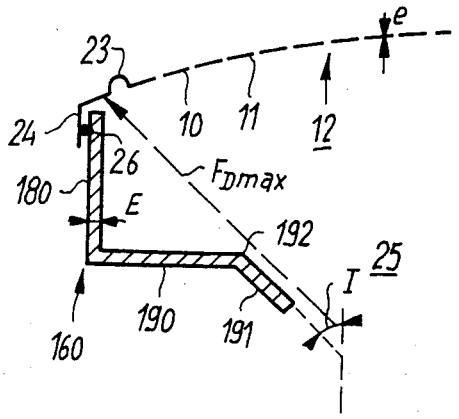
FIG. 5 a partial diagrammatic section of a short skirt mask with an internal lightweight frame.

Two embodiments of an assembly formed from a short skirt mask and a lightweight frame are diagrammatically and partly shown in sectional form in FIGS. 4 and 5. FIG. 4 shows the embodiment of a mask within the frame and FIG. 5 the embodiment with the mask outside the frame.

In FIGS. 4 and 5, the convex mask 12 provided with slots 11, is laterally bordered by a bent skirt 24, whose generatrix is parallel to the tube axis. The height of skirt 24 can be chosen as a function of the dimensions of mask 12, particularly its axial dimension (the distance between its apex and its base) and the height of the lateral wall or belt 180 of the L-sectional frame 160. In an advantageous embodiment, the height of skirt 24 is at the most between one quarter and a third of the height of belt 180 (e.g. in the case of a frame 160 having a belt height of approximately 22 mm, the skirt height can be approximately 7 mm. The thickness E of frame 160 can, for example, be chosen in such a way as to be approximately equal to or less than ten times the thickness e of mask 12 ($E/e \leqq 10$). In an embodiment where the thickness of the fabric 10 of mask 12 and of skirt 24 is 0.15 mm, the thickness of frame 150 is approximately 1.2 mm, the two members being made from rolled steel (sheet).

The unperforated border of fabric 10 of mask 12 can be provided with a rib 23. The radial part or base 191 of frame 160 has at its lower end a downward bend or lip 190, which starts a fold 192, chosen in such a way that the most deflected beam $F_{Dmax}$ can strike the border of mask 12 up to the vicinity of skirt 24, in order to reduce the temperature variations between the center and edge of the mask.

The inclination angles I between lips 191 and the horizontal and vertical median planes of the tube are preferably chosen at the most equal to the maximum deviation or deflection angle of the beam in the same, in order that no electron reflected by lip 191 will be directed towards the perforated area of the mask. In other words, in order to obtain a maximum uniform temperature distribution over the entire area of fabric 10 of mask 12, the opening window 25 formed in the base 190–191 of frame 160 must have adequate dimensions to permit the passage of beams deflected in the extreme case in the horizontal and vertical directions up to the edges of fabric 10. Fold 192 also serves to reinforce and rigidify the structure of lightweight frame 160.

In the two embodiments of the mask—light frame assembly, the skirt 24 can be joined to the upper part of belt 180 of frame 160 with the aid of spaced welds 26, e.g. in the manner described in FR-A-No. 1 470 260.

The fitting of frame 160 in the front panel of the tube is generally carried out in a conventional manner with the aid of leaf or plate springs respectively provided with bimetal compensating members.

It is pointed out that the embodiment of FIG. 4, in which the belt 180 of frame 160 surrounds the skirt 24 of mask 12 ensures a better thermal contact between the latter. However, the embodiment of FIG. 5, in which the parts of the skirt 24 which are not welded can temporarily move away from the outer face of belt 180 can lead to a relative slowing down in the temperature rise of frame 160. However, the temporary initial swelling can be slightly greater in the first case than in the second.

Figure 6:
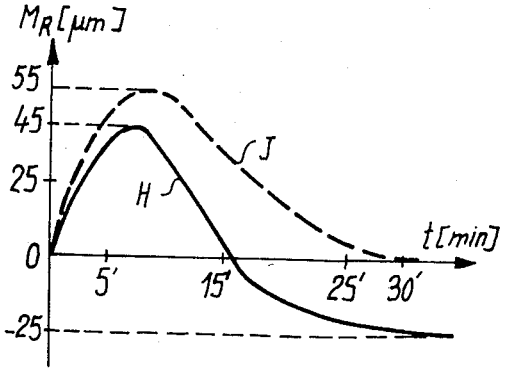
FIG. 6 graphs of the variation in the alignment fault of a mask with a heavy frame as a function of the operating time of the tube.

FIG. 6 shows variations in the alignment or register fault $M_R$ as a function of the operating period of the tube having a long skirt mask mounted on a conventional thick frame, e.g. of the type having a framė surrounding the entire height of the skirt.

On the abscissa is plotted the operating time t starting from t=0, while on the ordinate is plotted the alignment fault $M_R$ measured by the distance between axis of a thin beam of one color from the median vertical axis of the phosphor band of a given colour, on one or two points located on the horizontal median axis of the screen, three quarters the distance (or midway) between the center and the edge of the trichromatic lined screen. A radial difference in the direction of the center has been allocated a positive sign and that towards the edges a negative sign.

On the continuous line curve H of FIG. 6 illustrates the evolution of the alignment fault in time without temperature compensation by biplates, it is possible to see a positive maximum of 45 micrometers after 6 minutes' operation, a zero passage at 17 minutes and then an asymptotic approximation of a negative stable variation of −25 micrometers. The dotted line curve J indicates this same evolution with the use of compensating biplates with a positive maximum of 55 μm after 6.5 to 7 minutes, followed by a slow approximation of a slow positive (or negative) value, which becomes asymptotic after approximately 25 minutes' operation. Such alignment fault values are unacceptable for high or medium resolution tubes (0.5 mm spacing between the axes of slots 11).

Figure 7:
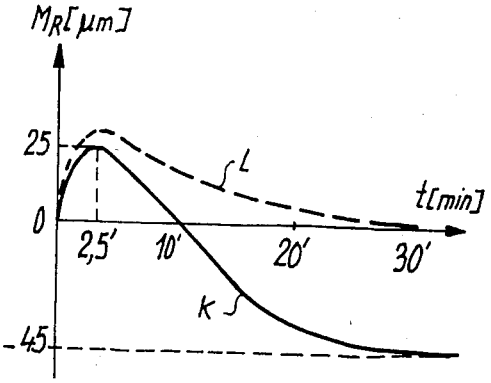
FIG. 7 an identical graph for a short skirt mask with a lightweight frame.

FIG. 7 shows graphs identical to those of FIG. 6 for a tube with a short skirt mask and a thin frame according to FIGS. 4 and 5. The continuous line curve K shows the time evolution of the alignment fault $M_R$ without compensation by biplates and the dotted line curve L when such compensation is provided. It can be seen that for a lightweight mask, the positive maximum of curve K is at 25 micrometers, i.e. approximately 40% lower than that of curve H of FIG. 6 and occurs after 2.5 minutes operation, i.e. half the time compared with a conventional mask. It then has a zero passage at 10 minutes, followed by an asymptotic approximation of a negative value of −45 micrometers. Curve L has a positive maximum of approximately 30 μm due to the swelling, followed by an asymptotic decrease towards a low positive or negative value.

FIGS. 6 and 7 confirm the deductions made on the basis of curves E, F and G in FIG. 3.

What is claimed is:

1. In a TV tube having a shadow mask including a peforated surface peripherally extending to a skirt, a support frame for the mask comprising:

a first flange attached at spaced points along the periphery thereof to the skirt;

a second flange forming a generally L-shaped cross-section with the first flange;

a frame rigidifying third flange extending from the second flange in a direction generally opposite the first flange and toward an axis of the tube, at most, at an angle substantially equal to the maximum deflection of a beam directed toward the mask-frame junction thereby ensuring beam impingement across the entire mask surface including the junction while blocking the second and first flanges from impingement thus minimizing temperature variations across the mask surface.

2. The structure set forth in claim 1, wherein the heating rates of the mask and frame become similar due to the height of the skirt being between $\frac{1}{3}$–$\frac{1}{4}$ the height of the second flange;

the thickness of the frame being less than or equal to ten times the thickness of the mask.

* * * * *